US008453857B2

(12) United States Patent
Battegazzore

(10) Patent No.: US 8,453,857 B2
(45) Date of Patent: Jun. 4, 2013

(54) TAMPER EVIDENT CLOSURE FOR CONTAINERS PROVIDED WITH A THREADED NECK

(75) Inventor: Piero Battegazzore, Alessandria (IT)

(73) Assignee: Guala Closures S.p.A., Alessandria Al (IT)

( * ) Notice: Subject to any disclaimer, the term of this patent is extended or adjusted under 35 U.S.C. 154(b) by 860 days.

(21) Appl. No.: 12/527,746

(22) PCT Filed: Feb. 21, 2008

(86) PCT No.: PCT/EP2008/001338

§ 371 (c)(1),
(2), (4) Date: Aug. 19, 2009

(87) PCT Pub. No.: WO2008/104313

PCT Pub. Date: Sep. 4, 2008

(65) Prior Publication Data

US 2010/0018942 A1 Jan. 28, 2010

(30) Foreign Application Priority Data

Feb. 27, 2007 (EP) ..... 07425104

(51) Int. Cl.
*B65D 39/00* (2006.01)

(52) U.S. Cl.
USPC ..... 215/252; 215/352; 215/274; 215/345; 220/319

(58) Field of Classification Search
USPC ..... 215/252, 352, 274, 345, 341, 343, 215/44, 214, 217, 45, 21, 901, 47, 250; 220/319, 220/304, 795, 310.1, 345.6, 806, 378
See application file for complete search history.

(56) References Cited

U.S. PATENT DOCUMENTS

| | | | | | |
|---|---|---|---|---|---|
| 2,647,652 | A | * | 8/1953 | Sanford | 215/337 |
| 3,044,651 | A | * | 7/1962 | Friedman | 215/44 |
| 3,348,718 | A | * | 10/1967 | Musy | 215/252 |
| 3,812,991 | A | | 5/1974 | Wurl | |
| 3,930,588 | A | * | 1/1976 | Coursaut | 215/230 |
| 4,511,053 | A | * | 4/1985 | Brandes et al. | 215/252 |

(Continued)

FOREIGN PATENT DOCUMENTS

| | | | |
|---|---|---|---|
| DE | 3722603 | C1 | 7/1988 |
| DE | 3833945 | C1 | 9/1989 |

(Continued)

OTHER PUBLICATIONS

International Search Report and Written Opinion issued from PCT/EP2008/001338, dated Apr. 1, 2008, 9 pages.

*Primary Examiner* — Mickey Yu
*Assistant Examiner* — Kareen Rush
(74) *Attorney, Agent, or Firm* — Rothwell, Figg, Ernst & Manbeck P.C.

(57) ABSTRACT

The present invention relates to a closure preferably for containers which have a standard threaded neck, which comprises a metal cap to prevent liquid from escaping from the container, a metal sleeve and a polymer ring which are coaxial relative to the latter, wherein the polymer ring comprises a first portion which has a diameter D1 and a second portion which has a diameter D2<D1, the metal cap comprises an end portion which is disposed around the second portion before the initial opening takes place, the closure being able, during the initial opening, to allow said end portion to pass over the first portion.

14 Claims, 9 Drawing Sheets

U.S. PATENT DOCUMENTS

| | | | | |
|---|---|---|---|---|
| 5,255,805 | A * | 10/1993 | Weiss et al. | 215/274 |
| 6,338,414 | B1 * | 1/2002 | Schellenbach | 215/252 |
| 6,403,173 | B1 * | 6/2002 | Granger et al. | 428/34.1 |
| 6,929,137 | B1 * | 8/2005 | Granger et al. | 215/252 |
| 6,981,600 | B1 * | 1/2006 | Battegazzore | 215/252 |
| 7,124,905 | B2 * | 10/2006 | Granger et al. | 215/329 |
| 2004/0060891 | A1 * | 4/2004 | Nishida | 215/252 |
| 2005/0211657 | A1 * | 9/2005 | Mallet et al. | 215/252 |
| 2006/0169665 | A1 * | 8/2006 | Matukawa et al. | 215/252 |
| 2008/0264893 | A1 * | 10/2008 | Battegazzore | 215/252 |
| 2009/0321378 | A1 * | 12/2009 | Battegazzore | 215/219 |

FOREIGN PATENT DOCUMENTS

| | | | |
|---|---|---|---|
| DE | 3909858 | A1 | 4/1990 |
| WO | 2004078612 | A1 | 9/2004 |
| WO | 2005012126 | A2 | 2/2005 |
| WO | 2006011002 | A1 | 2/2006 |

* cited by examiner

TAMPER EVIDENT CLOSURE FOR CONTAINERS PROVIDED WITH A THREADED NECK

CROSS REFERENCE TO RELATED APPLICATION(S)

This application is a 35 U.S.C. §371 National Phase Entry Application from PCT/EP2008/001338, filed Feb. 21, 2008, and designating the United States. This application also claims the benefit of European Patent Application No. 07425104.2 filed Feb. 27, 2007, the disclosure of which is incorporated herein in its entirety by reference.

TECHNICAL FIELD

The present invention relates to a closure for containers which have a threaded neck, the closure comprising an anti-prizing arrangement which can prevent extraction of the closure from the container, a metal cap which can prevent liquid from escaping from the container when the metal cap is applied to the container, a metal sleeve and a polymer ring, both of which are coaxial to the metal cap.

BACKGROUND OF THE INVENTION

Closures of this type are applied to containers which are provided with a neck and mouth, such as bottles, the neck of which is threaded, and preferably to containers which are provided with the so-called "standard threaded neck", i.e. a neck which is produced in accordance with standard UNI9574 or in accordance with standards equivalent to this, such as, for example, the French standard GME 30.06.

These bottles generally contain alcoholic liquids, such as wine for example, for which there is a need to indicate that the initial opening has taken place, such as to discourage any adulteration. U.S. Pat. No. 3,812,991 describes for example a metal closure which is provided with a sealing ring, which is likewise made of metal, provided in the lower end of the closure itself. The sealing ring is in turn subdivided into segments which indicate that the initial opening has taken place, by opening out towards the exterior.

On the other hand document DE 38 33 945 discloses a similar metal closure, in which the sealing ring, which is also divided into segments, is made of polymer material.

A common defect of both closures is that, after the initial opening, their sealing ring can be disposed such that when the bottle is closed again, the ring has the same appearance it had before the initial opening. In fact, although with a certain amount of difficulty, the segments of these rings can be returned to their original position, such that the external appearance is so similar to that of an intact closure that it can deceive most consumers.

There is therefore a need to provide a closure, which can also be applied to containers provided with a standard neck, the initial appearance of which is particularly difficult to restore after the initial opening has taken place, and which is therefore able to indicate that the initial opening has taken place better than what has been possible hitherto in the known art.

In view of the state of the art described, the object of the present invention is to provide a closure of this type.

SUMMARY OF THE INVENTION

According to the invention, this object is achieved by means of a closure for containers which have a threaded neck, the closure comprising an anti-prizing arrangement which can prevent extraction of the closure from the container, a metal cap which can prevent liquid from escaping from the container when the metal cap is applied to the container, a metal sleeve and a polymer ring, both of which are coaxial to the metal cap, wherein the anti-prizing arrangement is provided by an axial retention indentation which is provided on the metal sleeve or by the lower surface of the bulge of the metal sleeve together with inner tongues provided in the polymer ring, the polymer ring comprises a first portion which has a diameter D1 and a second portion which has a diameter D2<D1; at least one out of the metal cap and the metal sleeve comprise an end portion which is disposed around the second portion before the initial opening and the closure is able, during the initial opening, to permit passing over of the first portion by the end portion.

BRIEF DESCRIPTION OF THE DRAWINGS

The features and advantages of the present invention will become apparent from the following detailed description of a practical embodiment, provided by way of non-limiting example with reference to the attached drawings, in which.

DETAILED DESCRIPTION

Figure 1:
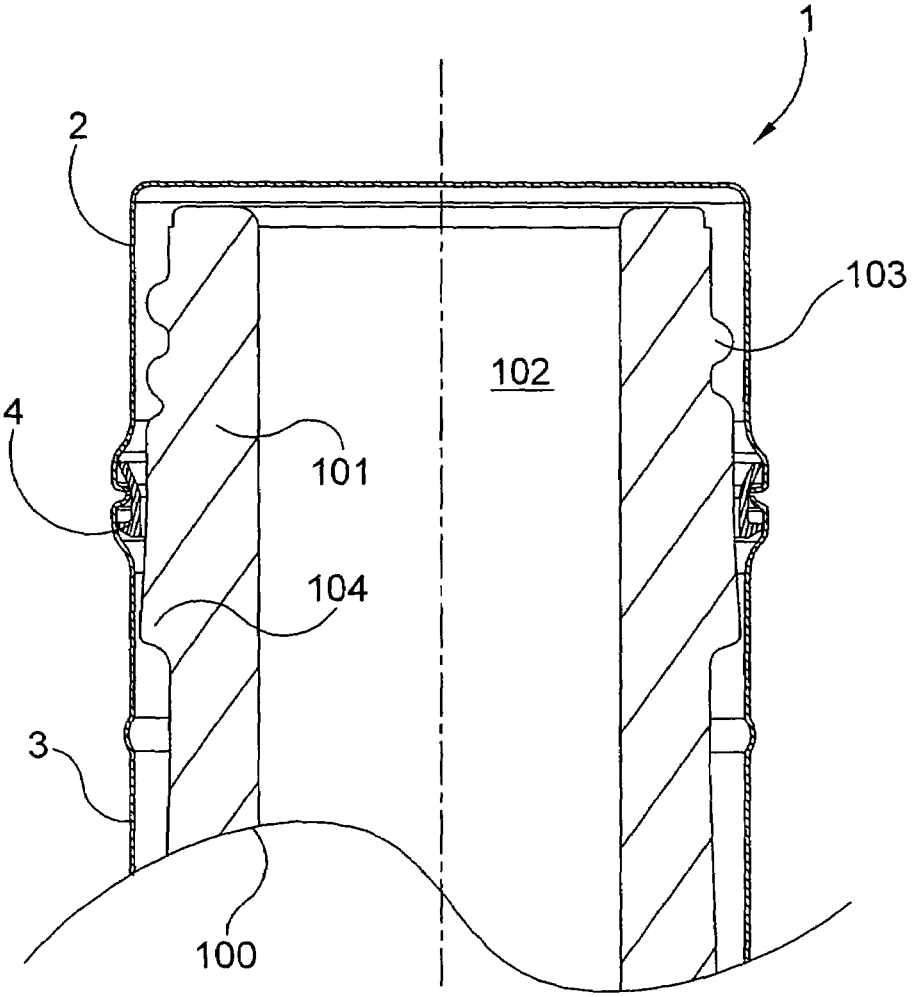
FIG. 1 is a view in cross-section of a closure according to a preferred embodiment of the closure according to the present invention, applied to the neck of a standard bottle, before the rolling operation.

With reference to FIGS. 1, 2*a* and 2*b*, 100 indicates a container provided with a standard threaded neck 101, on which there is applied a closure 1 according to a preferred embodiment of the present invention.

The closure 1 comprises a metal cap 2, which can prevent liquid from escaping from the container 100 when it is applied on the latter, a metal sleeve 3 and a polymer ring 4, both of which are coaxial relative to the metal cap 2.

The polymer ring 4 comprises a first portion 41 with an outer diameter D1 and a second portion 42 with an outer diameter D2<D1; at least one out of the metal sleeve 3 and the metal cap 2 comprises an end portion 21, 31, which is directed inwards and is disposed around the second portion 42 before the initial opening takes place. The closure 1 is also configured such that, during the initial opening, the end portion 21, 31 can pass over the first portion 41.

Generally, D2 is between 20 and 40 mm, whereas D1 is larger than D2 by a value of between approximately 0.2 and approximately 3 mm.

During the operation of initial opening of the container 100, the end portion 21 (or 31), which is disposed around the second portion 42, expands such as to pass over the first portion 41, and subsequently undergoes resilient contraction, preferably returning to its original configuration.

As an alternative or in combination, it can be the first portion 41 which contracts, subsequently undergoing resilient expansion, and preferably returning to its original configuration.

In this way, the first portion 41 is positioned longitudinally between an end portion 21 (or 31) and the other end portion 31 (or 21) with an obstructing function, such that, if the container 100 were closed by reapplying the closure 1, the metal cap 2 and the metal sleeve 3 would be separated at least by the first portion 41 placed between them.

By means of this configuration, after re-closure, the end portions 21 and 31 are spaced, with an obvious gap which shows visually that the container 100 has been opened and re-closed.

Advantageously, when the end portion 21 passes over the first portion 41, the end portion 31 retains the polymer ring 4 axially; alternatively, when the end portion 31 passes over the first portion 41, this function is provided by the end portion 21.

In the first case, after the initial opening, the polymer ring 4 will remain applied to the container 100; on the other hand, in the second case, it will be integral with the metal cap 2, and will therefore be easier to tamper with.

As can be seen in the embodiment in FIG. 1, there is a space between the vertical portion 22 and the thread 103; similarly, there is also a space between the vertical portion 32 and the projection 104.

Figure 4:
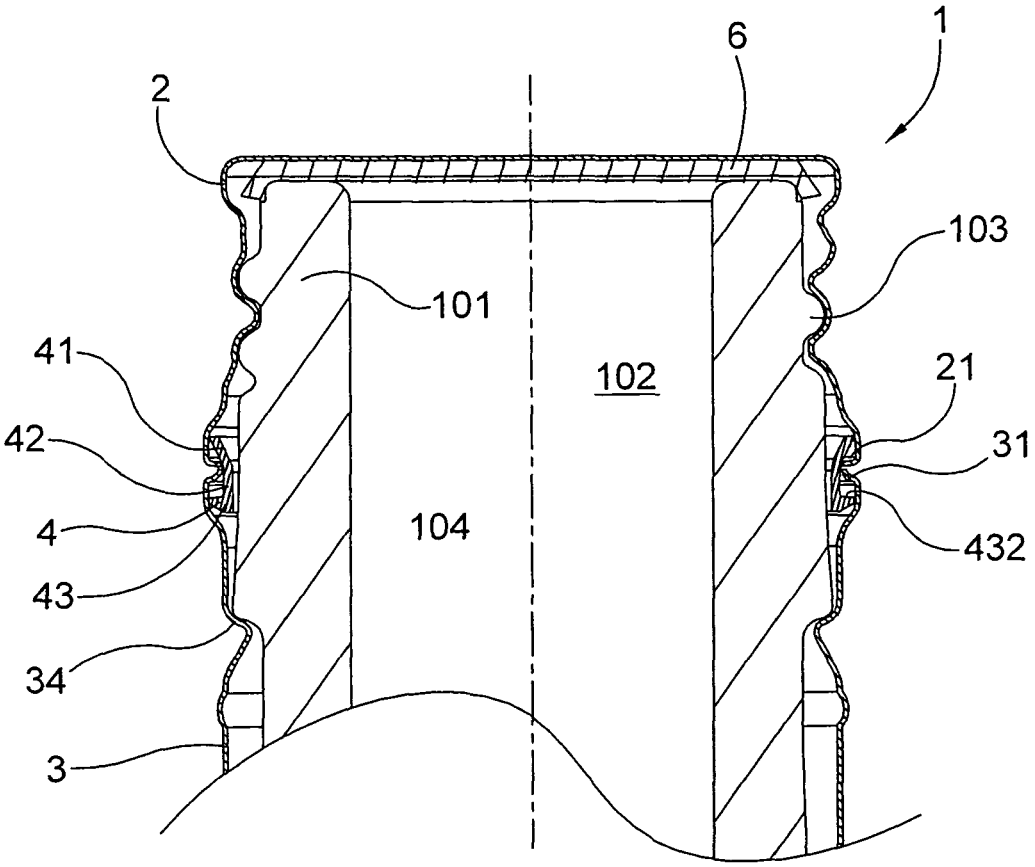
FIG. 4 shows the closure in FIG. 1 after the rolling operation.

The size of these spaces can not be too large, as otherwise the successive rolling operation (see FIG. 4) could not be carried out in an optimum manner. Independently of their precise value, these spaces give rise to the presence of two bulges 23, 33, in the vicinity of the terminal ends of the metal cap 2 and of the metal sleeve 3.

The bulges 23, 33 together accommodate the ring 4, and in turn comprise the end portions 21, 31, which are arranged facing one another before the initial opening of the closure takes place.

They also serve the purpose of preventing the polymer ring 4, which is pushed during the re-closure operation, from being able to disappear inside the metal sleeve 3 or the metal cap 2, according to the configuration of the closure 1.

The metal cap 2 and the metal sleeve 3 can be completely separated from one another by means of a circumferential cutting line, which can be imperceptible or almost so, and which extends around 360°, or preferably they can be connected to one another by breakable metal bridges 24 (indicated in FIG. 2*b*), which can be torn during the initial opening operation. In the first case, the metal cap 2 and the metal sleeve 3 are mechanically separated from one another, i.e. there is no connection bridge between them, and, during the initial opening, when the end portion 21 (or 31) passes over the first portion 41, the axial movement of the polymer ring 4 is blocked by the other end portion 31 (or 21).

On the other hand in the second case, during the initial opening, the bridges 24 are stressed such as to be subjected to traction and/or shear, being torn at first and then allowing the passing over of the first portion 41 as previously described.

The outer surface 411 of the first portion 41 can be divergent from the second portion 42, preferably in a frusto-conical form; it can also be interrupted at more than one point, for example by means of radial notches (not shown) which make it possible to modulate its resilience.

The angle at the vertex of the cone defined by the outer surface 411 is advantageously between 10° and 120°, with a preferred value of 50°, such as to facilitate the passing over as far as possible.

Advantageously, the closure 1 is configured such that, after the initial opening, the end portion 21 (or 31) which has passed over the first portion 41 can no longer pass over it in the inverse direction, in order to be disposed once more outside the second portion 42, thus preventing restoration of the initial configuration.

For example the thickness S of the first portion 41 can be substantially constant and such that, when the metal cap 2 is screwed onto the container 100 once more, the end portion 21 (or 31) tends to be inserted inside the first portion 41, between the latter and the container 100 itself.

Alternatively, the inner wall 412 of the first portion 41 can be substantially cylindrical, such that the end surface 413 of the first portion has the end portion 21 (or 31) abutted against it during a re-closure operation.

Advantageously, the polymer ring 4 comprises a third portion 43, with an outer diameter D3>D2 (with D3 substantially equal to D1), axially opposite the first portion 41 relative to the second portion 42.

The outer surface 421 of the second portion 42 is represented as cylindrical, but it can clearly also have other forms, for example it can be concave. In the examples in the figures, going from top to bottom, there are, in order, the portions 41, 42 and 43; in this example the end portion 21 passes over the portion 41 and the end portion 31 retains the portion 43, and thus the polymer ring 4, on the container 100.

It is however possible to conceive an opposite arrangement, in which the cross-section of the polymer ring can be the other way up, with the first portion 41 disposed at the bottom; in this case the functions of the end portions 21, 31 will be inverted, with the end portion 31 now passing over the first portion 41.

The portions 41, 42 and 43 of the polymer ring 4 thus define a hollow annular seat 46 which is advantageously asymmetrical, in which the end portions(s) 21, 31 is/are disposed before the initial opening takes place, adjacent to one another.

Depending on the orientation of the polymer ring 4, it is thus possible to carry out the passing over of the first portion 41 from the top (when it is the portion 21 which is passing over) or from the bottom (when it is the portion 31 which is passing over).

Figures 2A, 2B:
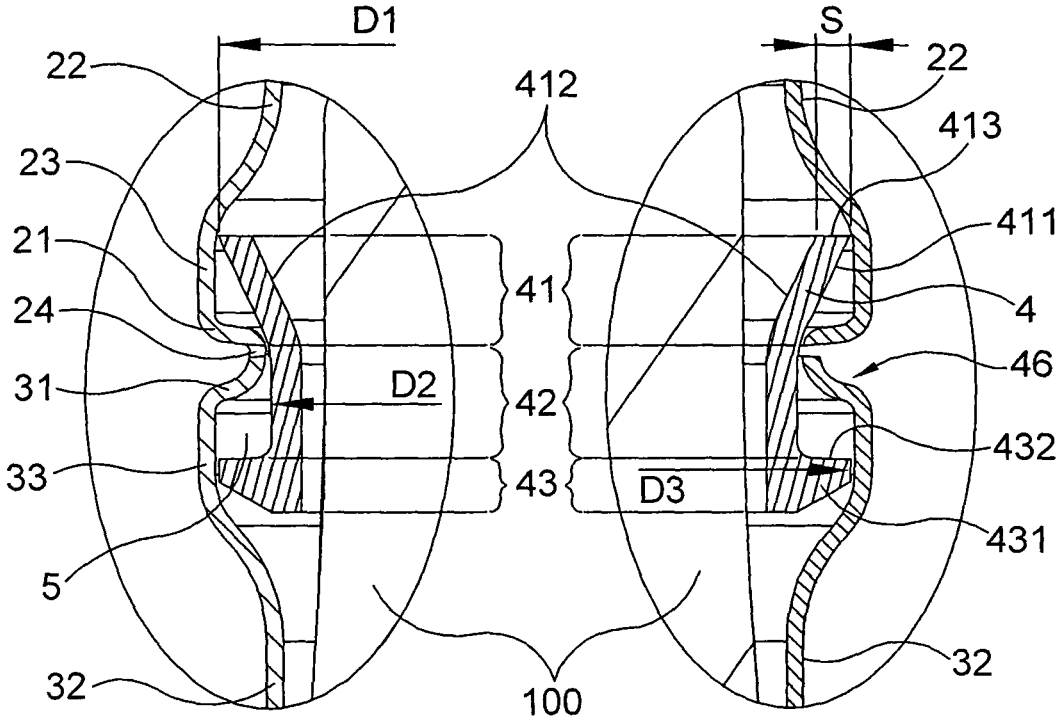
FIGS. 2*a* and 2*b* show two enlargements of FIG. 1.

As can be seen clearly in FIGS. 2*a* and 2*b*, the first portion 41 and the third portion 43 can have profiles which differ from one another. In particular, the third portion 43 comprises a portion 431 which projects radially towards the exterior, on which a stop surface 432 is provided.

The stop surface 432 blocks the end portion 31 of the metal sleeve 3, which is external to it.

As can be seen in FIG. 2, the polymer ring 4 is provided with an interruption 44 of the SEIGER ring type. Optionally, the two ends 441, 442 are connected by one or more bridges 45, such as to avoid localised deformations, even for rings which have a relatively thin cross-section.

The outer diameter at rest of the polymer ring 4 can advantageously be greater than the inner diameter of the metal cap 2 and/or of the metal sleeve 3 which are immediately adjacent to it, such as to create slight expansion tension which facilitates the assembly of the closure 1 on the container 100.

Figure 5:
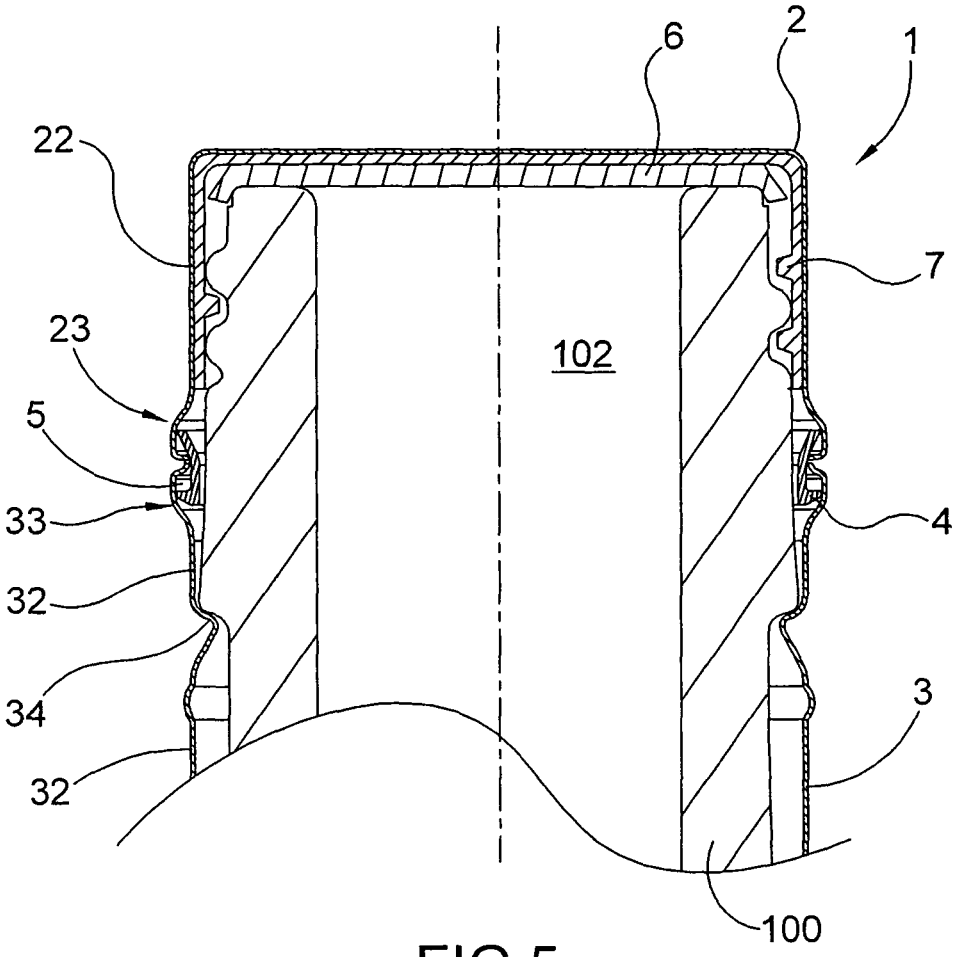
FIG. 5 shows a second preferred embodiment of the closure according to the present invention.

In FIGS. 2*a* and 2*b*, 5 indicates a gap between the end portion 31 or 21 and the stop surface 43; this delays the passing over of the first portion 41 by the end portion 21 (or 31) with respect to the rupture of bridges 24 (if any) which connect the metal sleeve to the metal cap, such as to reduce the opening force and to avoid extracting the metal sleeve 3 at the time of opening.

The gap 5 has an axial size of between approximately 0.3 mm and approximately 2 mm. The material of which the metal cap 2 and ring 3 are made can be aluminium, with a thickness which is advantageously between 0.2 mm and 0.25 mm and is advantageously 0.22 mm, whereas the material of which the polymer ring 4 is made is preferably selected from the group comprising POM, polyamide and PP.

The closure 1 can optionally also comprise an insert 6 made of material with low rigidity (which can be seen only in FIGS. 4 to 9), which is disposed inside the metal cap 2 and can assure the sealing of the closure 1 on the container 100.

Figure 3:
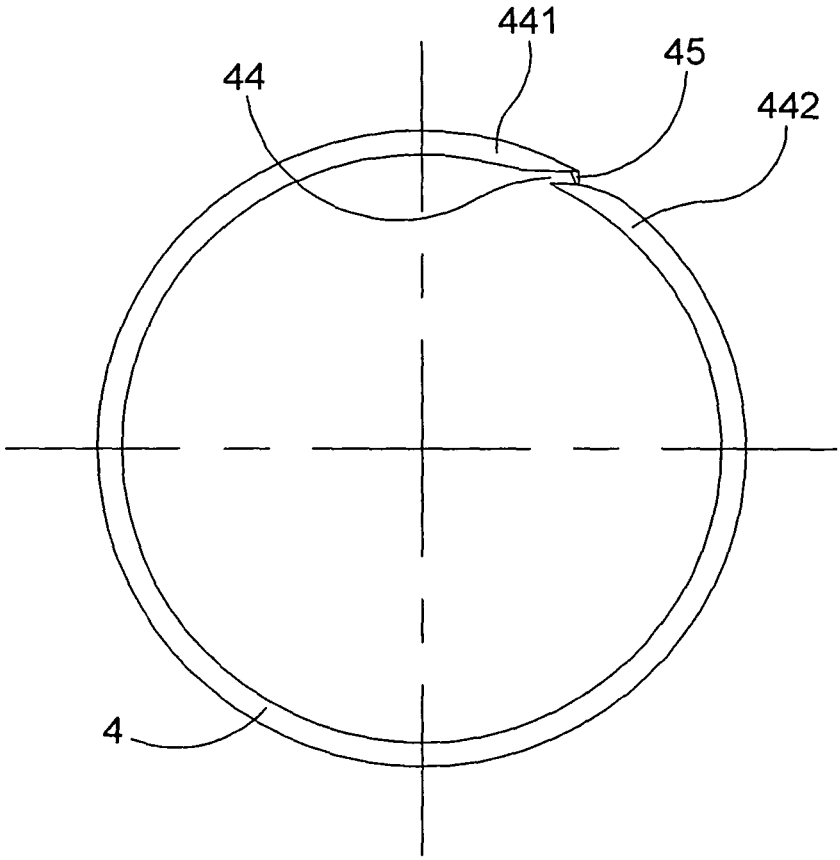
FIG. 3 shows a view from above of the polymer ring of the closure in FIG. 1.

Alternatively and/or in addition, there can be an internally-threaded element 7 (which can only be seen in FIGS. 5 to 7), such as the one described in application WO 2006/011002 A1 in the name of the applicant, the entire content of which, and in particular FIGS. 2 and 3, lines 6-9 of page 6, and from line 19 on page 7 to line 9 on page 8, is incorporated here for the purpose of reference. The threaded insert 7 can be released from the polymer ring 4 (as can be seen in FIG. 5), or it can be connected to it by means of breakable bridges 71 (as can be seen in FIGS. 6 and 7).

Figure 6:
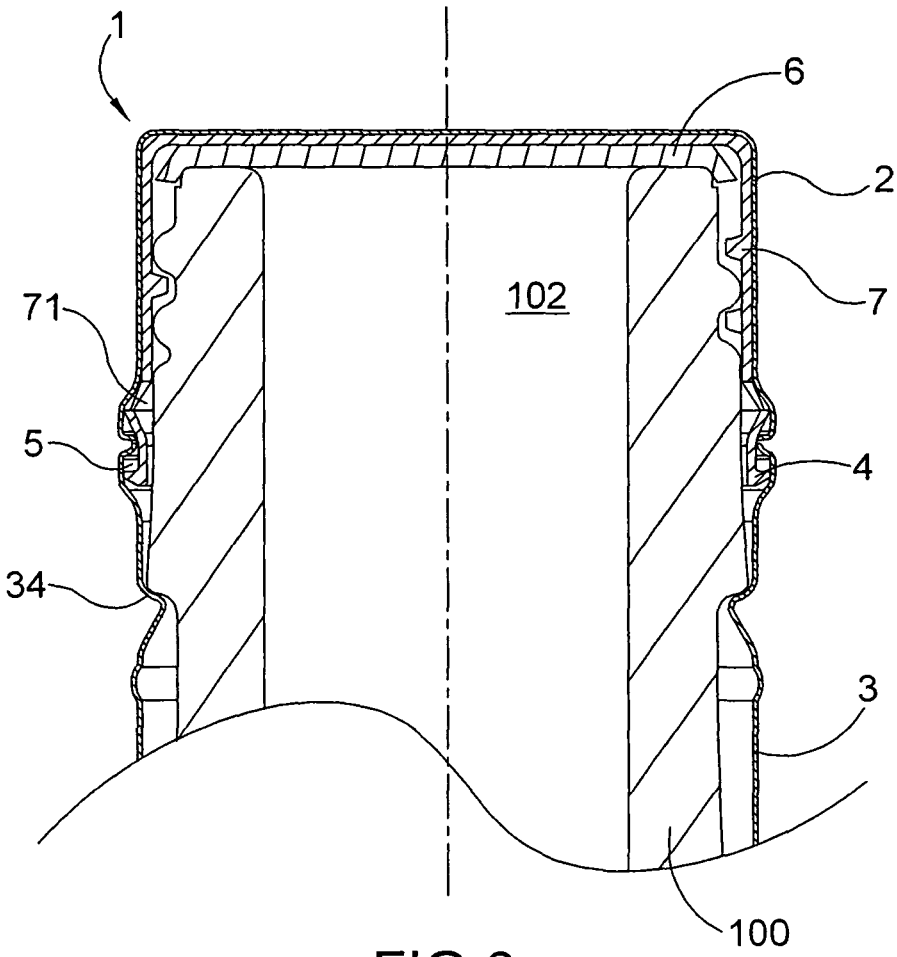
FIG. 6 shows a third preferred embodiment of the closure according to the present invention.
Figure 7:
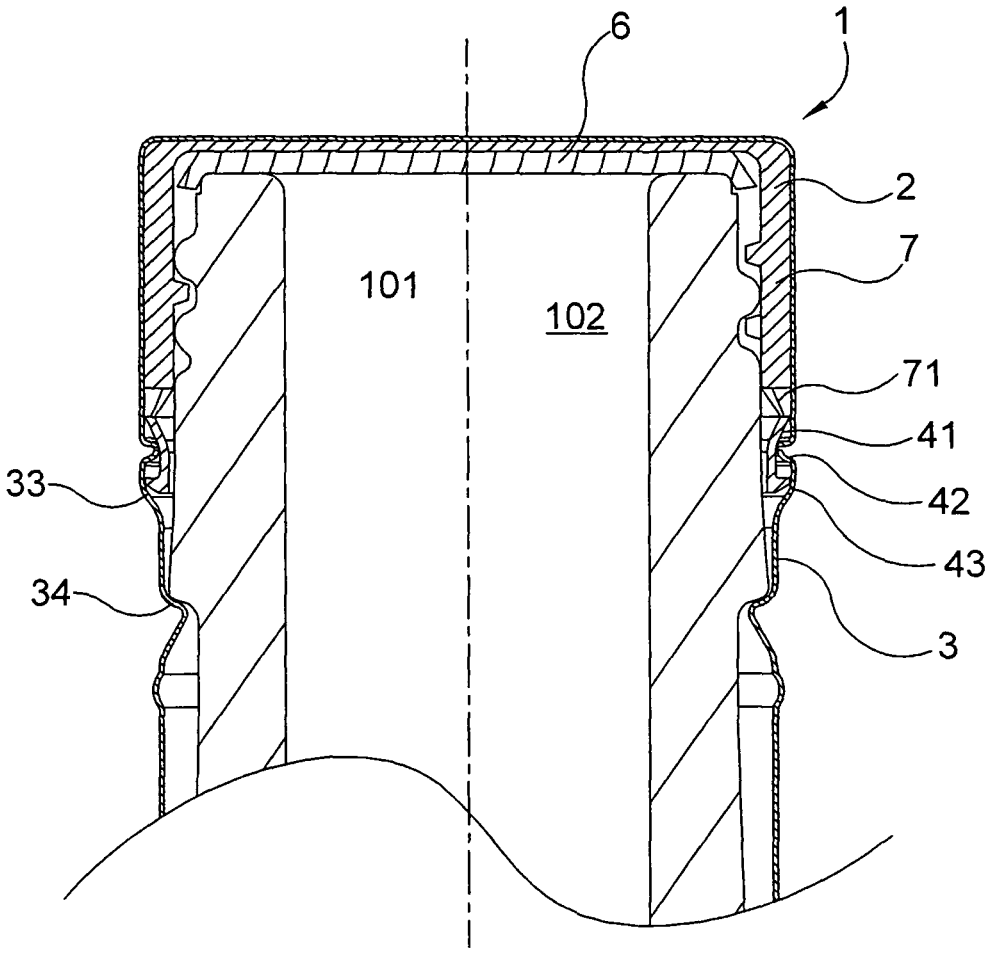
FIG. 7 shows a fourth preferred embodiment of the closure according to the present invention.

In the embodiment in FIG. 7, the inner ring 7 has a wall with a thickness greater than the thickness of the inner ring 7 of the embodiment in FIGS. 5 and 6. This results in the absence of the bulge 23. This therefore provides a closure with an outer surface which is more suitable for the application of decorations, but nevertheless indicates that the initial opening has taken place.

Figure 8:
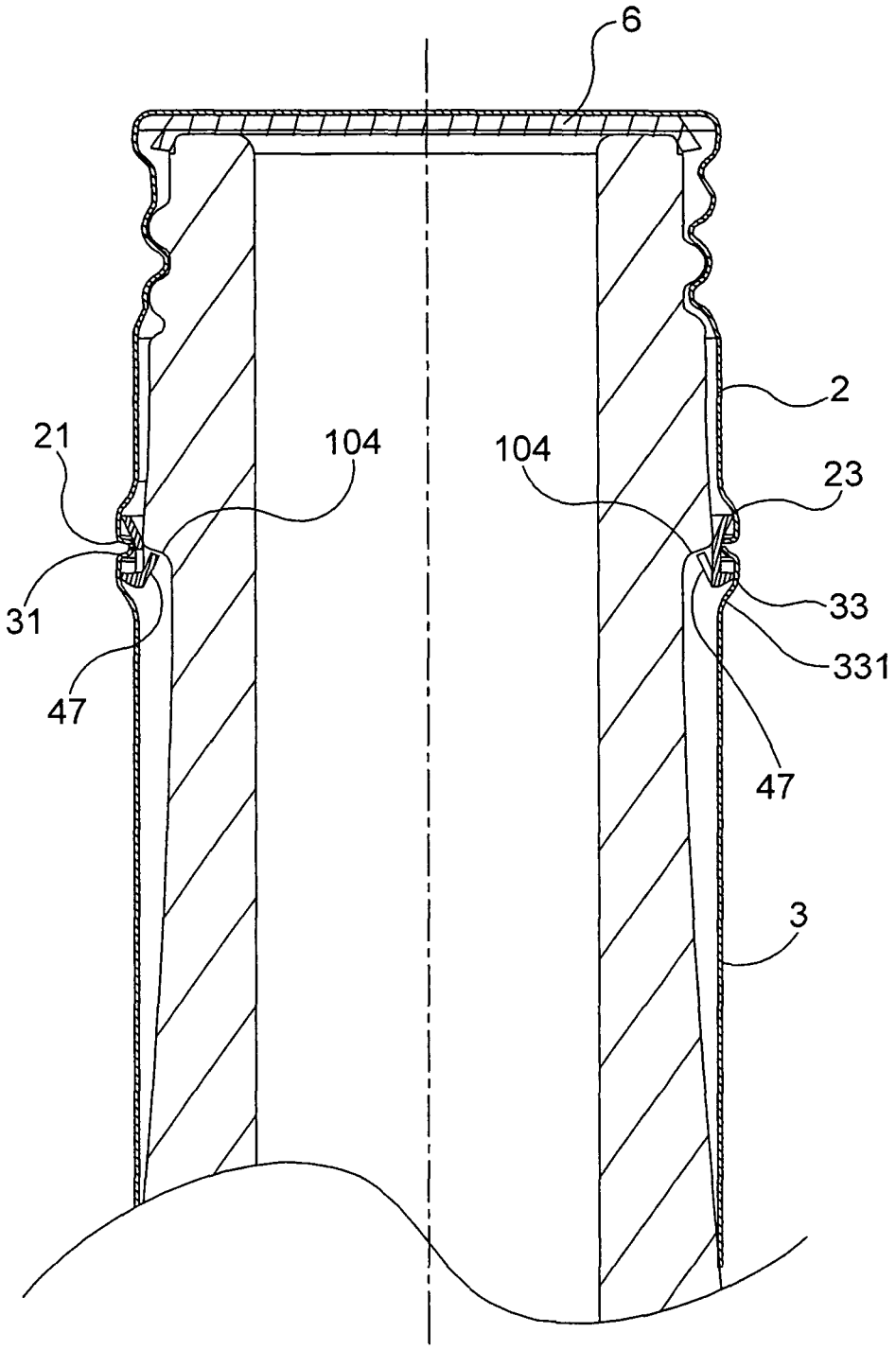
FIG. 8 shows a fifth preferred embodiment of the closure according to the present invention.
Figure 9:
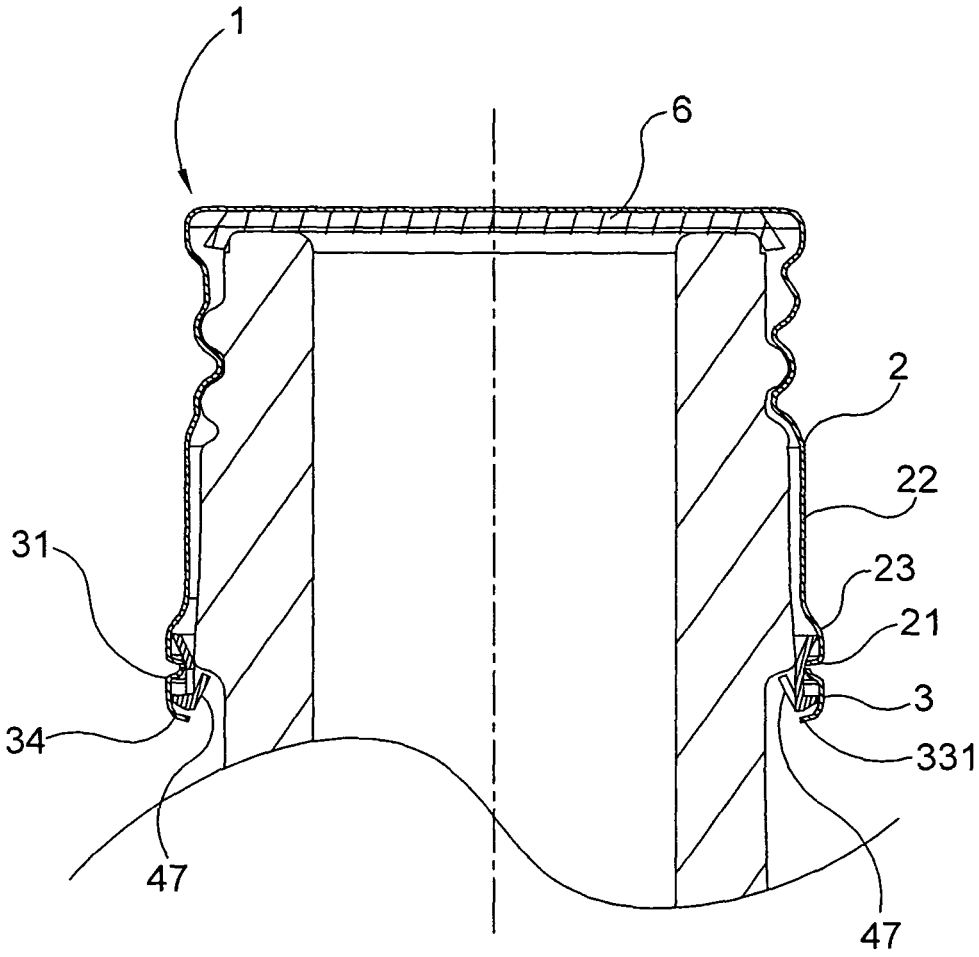
FIG. 9 shows a sixth preferred embodiment of the closure according to the present invention.

In the embodiments in FIGS. 8 and 9, the polymer ring 4 comprises a plurality of inner tongues 47, which engage on projection 104 of container 100. This makes it possible to use a metal sleeve 3 which is smooth on the exterior, for example by eliminating the axial retention indentation 34 which is present in the embodiments in FIGS. 4, 5, 6 and 7.

A variant embodiment of the metal sleeve 3 is shown in FIG. 9, in which the metal sleeve 3 is more particularly a ring with a reduced axial extension. A further embodiment, not shown, is the one which can be obtained from the embodiment in FIG. 8: in this embodiment, the metal sleeve 3 is retained axially upwards by means of the inner tongues 47, by the lower indented surface 331 of the bulge 33, and downwards by abutting to the container 100 itself. There is therefore no need to provide the indented end portion 31.

A feature which is common to all the embodiments according to the present invention is that the closure 1 can be applied to containers 100 which are provided with a threaded neck 101, wherein the thread 103 of the neck 101 engages with the closure 1 itself. "Neck of the container" means the part which, in glass bottles, is made of glass, integrally with the rest of the container, and can be identified as such before the assembly of the closure 1 on the container 100 itself.

The present invention therefore excludes closures comprising a threaded element which engages with the cap of the closure itself, since in these the thread is not provided on the container, but inside the closure itself. For this reason the latter belong to a different technical field.

In other words, the anti-prizing arrangement which prevent the extraction of the closure 1 from the container 100 can always be fastened to the lower surface of the projection 104, and consist exclusively only of the indentation 34 of the metal sleeve 3, or of the bulge 23, 33, through the tongues 47 of the polymer ring 4.

In order to satisfy contingent and specific requirements, a person skilled in the art will be able to provide many modifications and variations of the above-described configurations, all of which however come within the scope of protection of the invention as defined by the following claims.

The invention claimed is:

1. A closure for containers which have a threaded neck, said closure comprising:

an anti-prizing arrangement configured to prevent extraction of said closure from said container;

a metal cap, configured to prevent liquid from escaping from said container when said metal cap is applied to said container;

a metal sleeve and a polymer ring, both of which are coaxial to said metal cap, said metal sleeve comprising a bulge having a lower surface;

wherein said anti-prizing arrangement is provided by an axial retention indentation which is provided on said metal sleeve, or by the lower surface of the bulge of the metal sleeve together with inner tongues provided in said polymer ring;

said polymer ring comprises a first portion which has a diameter D1 and a second portion which has a diameter D2<D1;

at least one of said metal cap and said metal sleeve comprises an end portion which is disposed around said second portion before an initial opening of said closure; and said closure being able, during the initial opening, to permit passing over of said first portion by said end portion.

2. The closure according to claim 1, which, after the initial opening, can prevent said end portion from passing over said first portion, in order to be disposed around said second portion.

3. The closure according to claim 1, wherein said end portion is provided on said metal cap.

4. The closure according to claim 1, wherein said end portion is provided on said metal sleeve.

5. The closure according to claim 1, wherein said metal cap is separated from said metal sleeve by means of a cutting line which extends 360° around said closure.

6. The closure according to claim 1, wherein, before the initial opening, said metal cap is connected to said metal sleeve by breakable metal bridges, said bridges being able to be torn during the initial opening operation.

7. The closure according to claim 1, wherein the outer surface of said first portion is substantially frusto-conical, and diverges from said second portion.

8. The closure according to claim 1, wherein said polymer ring comprises a third portion with an outer diameter D3>D2 which is axially opposite said first portion relative to said second portion.

9. The closure according to claim 1, wherein said first portion comprises one or more radial notches.

10. The closure according to claim 8, wherein said third portion comprises a portion which projects radially towards the exterior, and on which there is provided a stop surface, which, between said metal cap and sleeve, can retain the one disposed around it.

11. The closure according to claim 1, wherein said polymer ring is interrupted by a notch.

12. The closure according to claim 1, wherein said polymer ring comprises a third portion including a portion which projects radially towards the exterior, and on which there is provided a stop surface, which, between said metal cap and sleeve, can retain the one disposed around it.

13. A closure for containers which have a threaded neck, said closure comprising:

an anti-prizing arrangement configured to prevent extraction of said closure from said container;

a metal cap, configured to prevent liquid from escaping from said container when said metal cap is applied to said container;

a metal sleeve and a polymer ring, both of which are coaxial to said metal cap, said metal sleeve comprising a bulge having a lower surface;

wherein said anti-prizing arrangement is provided by an axial retention indentation which is provided on said metal sleeve, or by the lower surface of the bulge of the metal sleeve together with inner tongues provided in said polymer ring;

said polymer ring comprises a first portion which has a diameter D1 and a second portion which has a diameter D2<D1;

at least one of said metal cap and said metal sleeve comprises an end portion which is disposed around said second portion before an initial opening of said closure;

said closure being able, during the initial opening, to permit passing over of said first portion by one said end portion; and after reclosure, said metal cap and said metal sleeve being separated at least by said first portion placed between them, thereby said end portion which passed over said first portion and either said metal cap or said metal sleeve that did not pass over the first portion are spaced.

14. A closure for containers which have a treaded neck, said closure comprising:

an anti-prizing arrangement configured to prevent extraction of said closure from said container;

a metal cap, configured to prevent liquid from escaping from said container when said metal cap is applied to said container;

a metal sleeve and a polymer ring, both of which are coaxial to said metal cap, said metal sleeve comprising a bulge having a lower surface;

wherein said anti-prizing arrangement is provided by an axial retention indentation which is provided on said metal sleeve, or by the lower surface of the bulge of the metal sleeve together with inner tongues provided in said polymer ring;

said polymer ring comprises a first portion which has a diameter D1 and a second portion which has a diameter D2<D1;

at least one of said metal cap and said metal sleeve comprises an end portion which is disposed around said second portion before an initial opening of said closure;

said closure being able, during the initial opening, to permit passing over of said first portion by said end portion; and said closure being configured such that, after the initial opening, said end portion which has passed over said first portion is prevented from passing over said first portion in an inverse direction, thereby preventing restoration of the configuration before the initial opening.

* * * * *